United States Patent [19]

Roemer et al.

[11] Patent Number: 4,627,763

[45] Date of Patent: Dec. 9, 1986

[54] VEHICLE BARRIER CONSTRUCTION

[75] Inventors: Mitchel B. Roemer, Amherst; Nicholas B. Roemer, Elma, both of N.Y.

[73] Assignee: Roemac Industrial Sales, Inc., North Tonawanda, N.Y.

[21] Appl. No.: 627,445

[22] Filed: Jul. 3, 1984

[51] Int. Cl.[4] ..... E01F 13/00

[52] U.S. Cl. ..... 404/6; 404/11; 49/33

[58] Field of Search ..... 404/6, 10, 9, 11; 256/13.1; 403/114, 122; 14/36, 38, 39, 69.5, 71.1, 71.3, 71.7; 49/33, 49, 131, 9

[56] References Cited

U.S. PATENT DOCUMENTS

| | | | |
|---|---|---|---|
| 1,692,425 | 11/1928 | Strauss | 49/9 |
| 1,848,517 | 3/1932 | Davison | 49/9 |
| 1,949,295 | 2/1934 | Dean | 404/11 |
| 2,362,912 | 11/1944 | Logan, Jr. | 246/130 |
| 2,741,859 | 4/1956 | Castle | 39/6 |
| 3,137,876 | 6/1964 | Loomis | 14/69.5 |
| 3,748,782 | 7/1973 | Reynolds | 49/49 |
| 4,152,871 | 5/1979 | Kardash, Jr. | 49/49 |
| 4,274,172 | 6/1981 | Frankin | 14/69.5 |
| 4,354,771 | 10/1982 | Dickinson | 49/49 |
| 4,407,484 | 10/1983 | Meinzer | 404/6 X |
| 4,490,068 | 12/1984 | Dickinson | 404/11 |
| 4,574,523 | 3/1986 | Nasatka | 49/49 |

FOREIGN PATENT DOCUMENTS

| | | | |
|---|---|---|---|
| 3112717 | 10/1982 | Fed. Rep. of Germany | 49/49 |
| 392050 | 5/1933 | United Kingdom | 404/6 |

*Primary Examiner*—James A. Leppink
*Assistant Examiner*—Matthew Smith
*Attorney, Agent, or Firm*—Joseph P. Gastel

[57] ABSTRACT

A vehicle barrier including a housing located in a pit, a barrier pivotally mounted on the housing and having a roadway surface and a barrier surface, hydraulic motors for moving the barrier from a retracted position where said roadway surface lies substantially flush with the roadway to an extended position where the barrier surface obstructs a vehicle on the roadway, energy absorbing members in the barrier, a break-away member effectively located between the barrier and the housing for permitting the barrier to pivot beyond its normal extended position when subjected to a vehicular impact above a predetermined value to thereby lift a vehicle off of the ground and throw it upwardly, and self-aligning structure between the barrier and the housing for effecting engagement between the hydraulic motors and the barrier upon installing the barrier into the housing.

15 Claims, 18 Drawing Figures

Fig. 1.
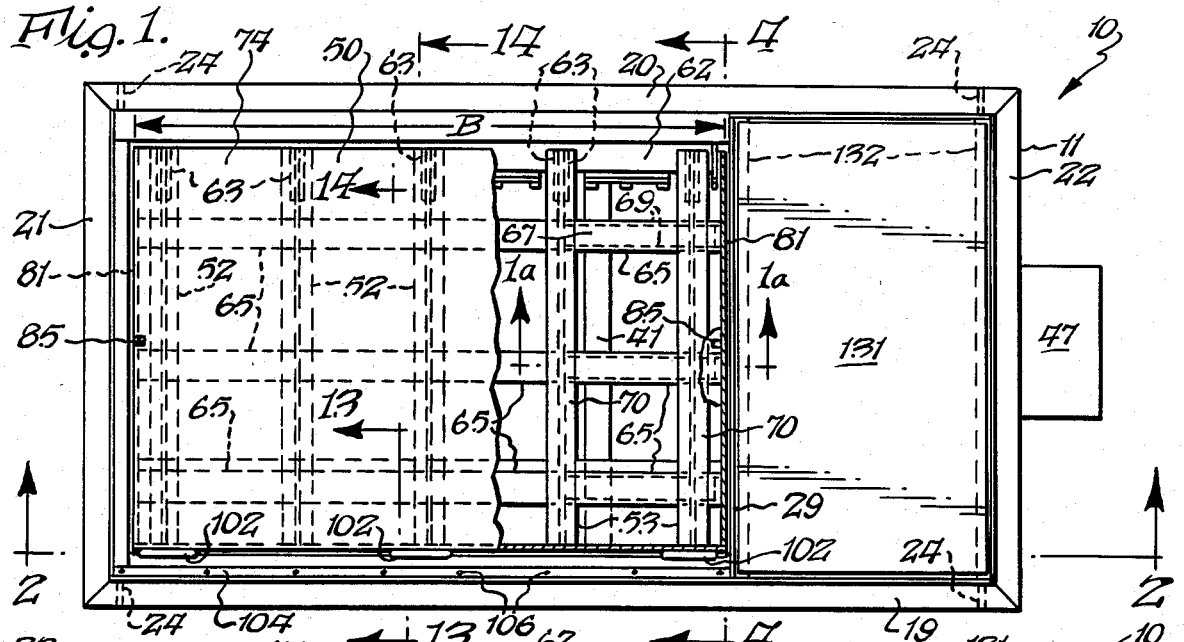
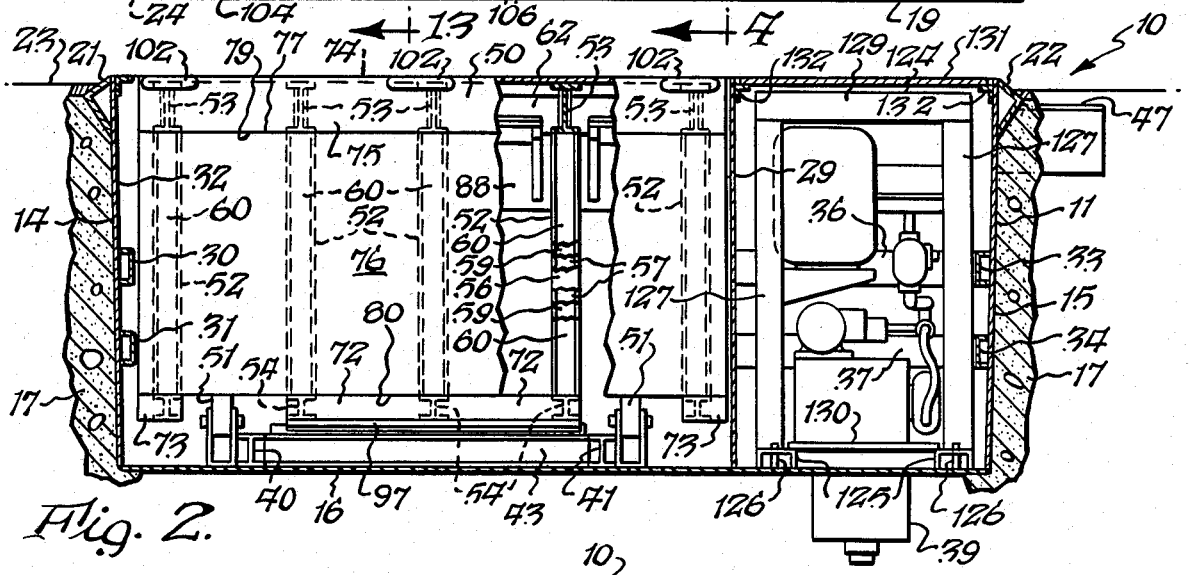
Fig. 2.
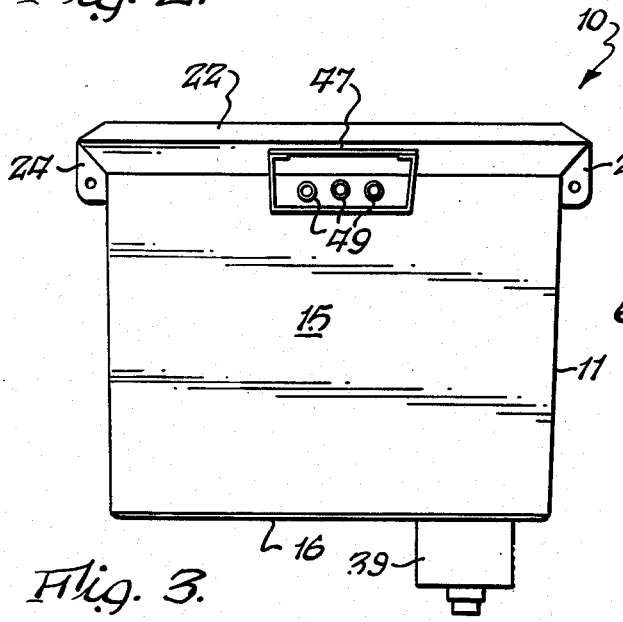
Fig. 3.
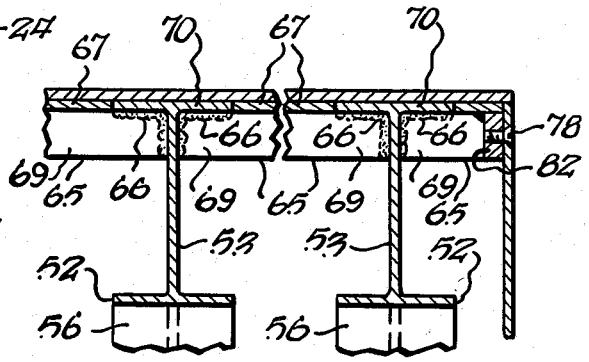
Fig. 1a.

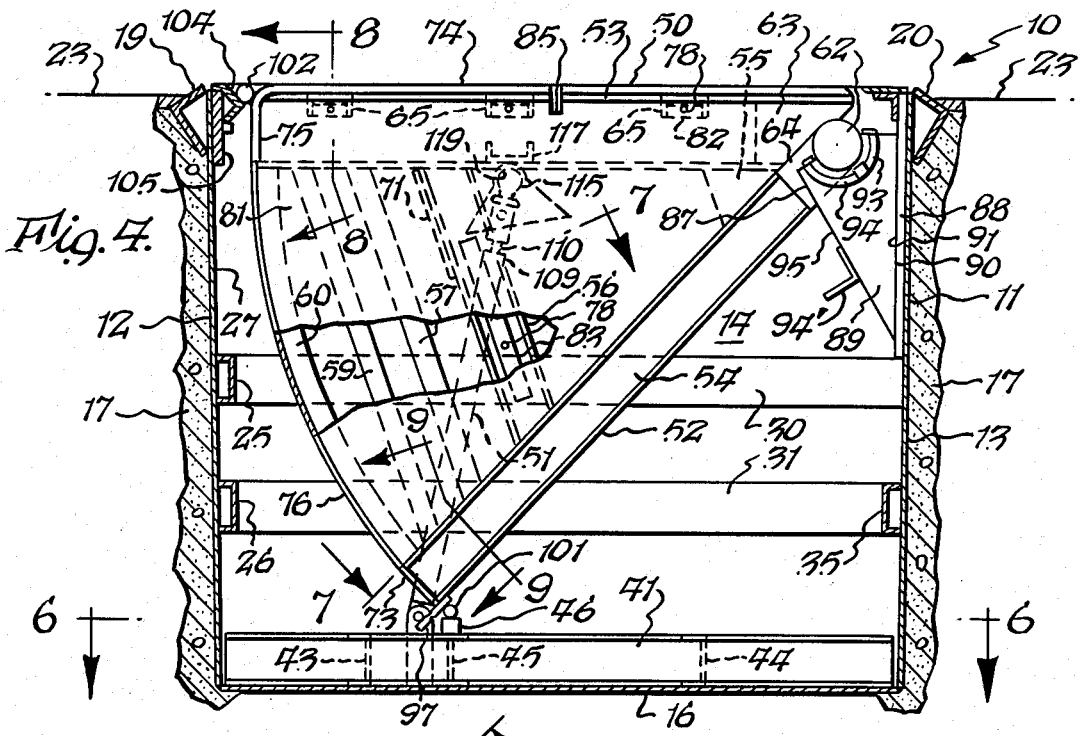
Fig. 4.
10
19
20
23
23
104
102
8
74
85
53
50
78
55
63
62
65
75
119
117
65
82
64
105
81
71
115
7
87
93
94
88
91
90
11
8
110
109
56
78
83
95
60
57
12
27
14
94'
89
59
54
17
17
25
9
52
30
13
51
31
76
26
101
35
7
73
9
46'
41
6
6
43
45
44
97
16
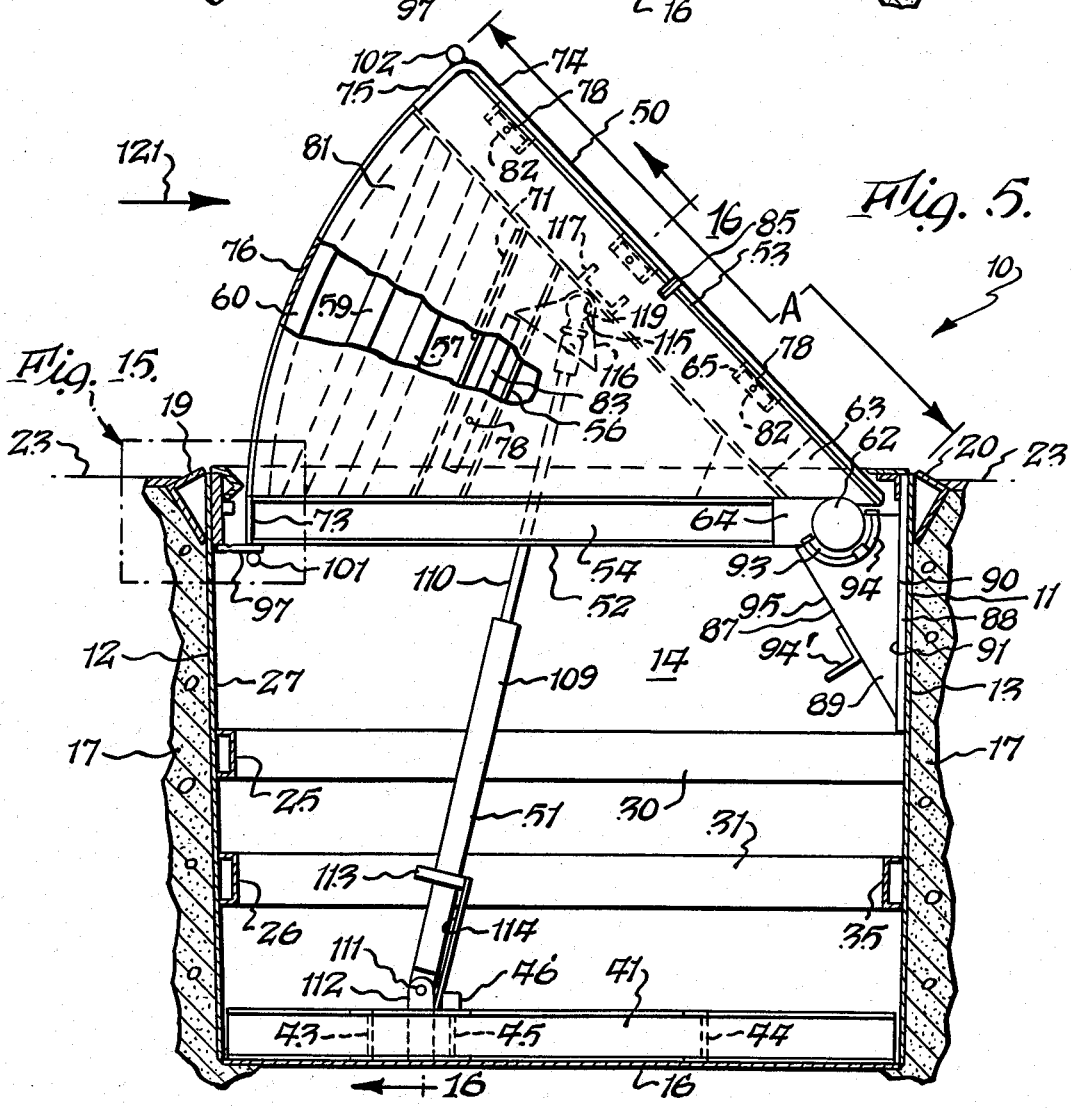
Fig. 5.
Fig. 15.
102
74
75
78
50
121
81
82
71
16
85
53
117
76
60
59
119
A
10
57
115
116
65
78
83
56
78
82
63
62
20
19
23
23
73
64
101
110
54
93
94
90
11
97
52
95
87
88
12
27
109
14
94'
91
89
13
17
17
25
51
30
31
113
26
114
35
111
112
46'
41
43
45
44
16
16

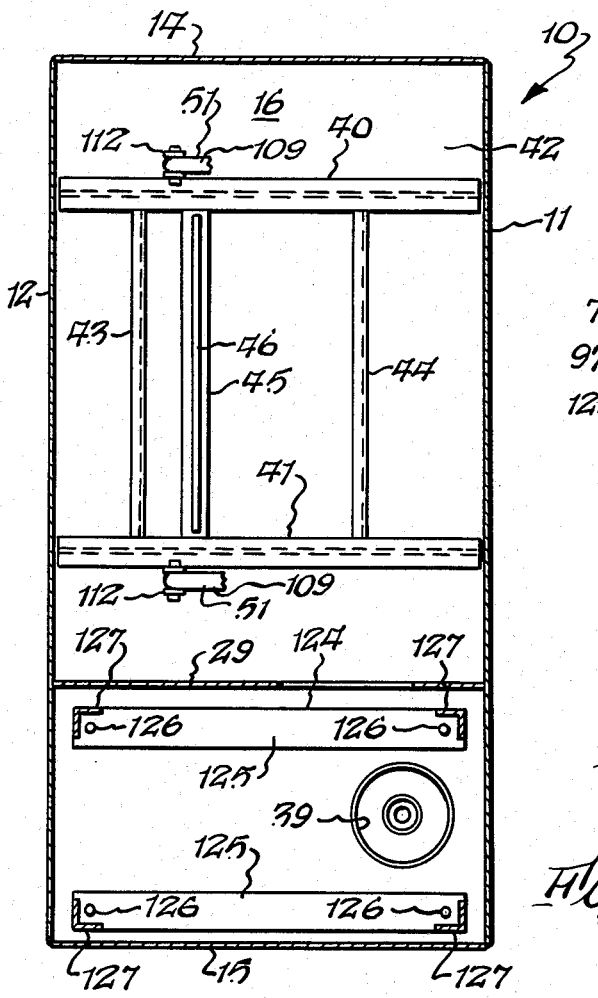
Fig. 6.
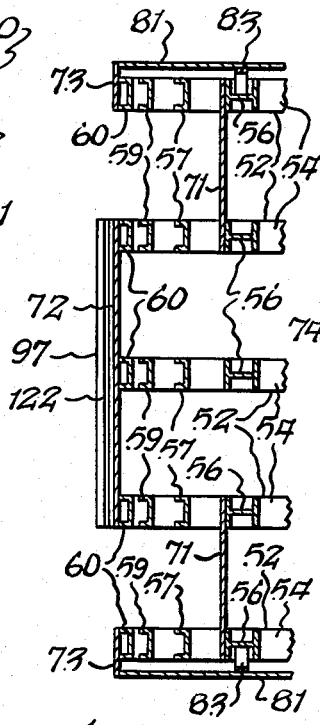
Fig. 7.
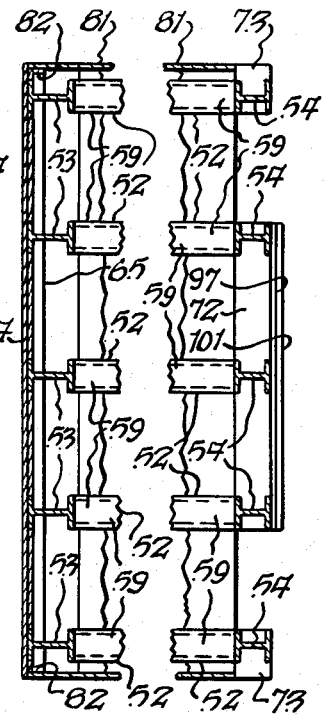
Fig. 8.
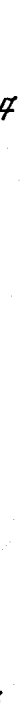
Fig. 9.
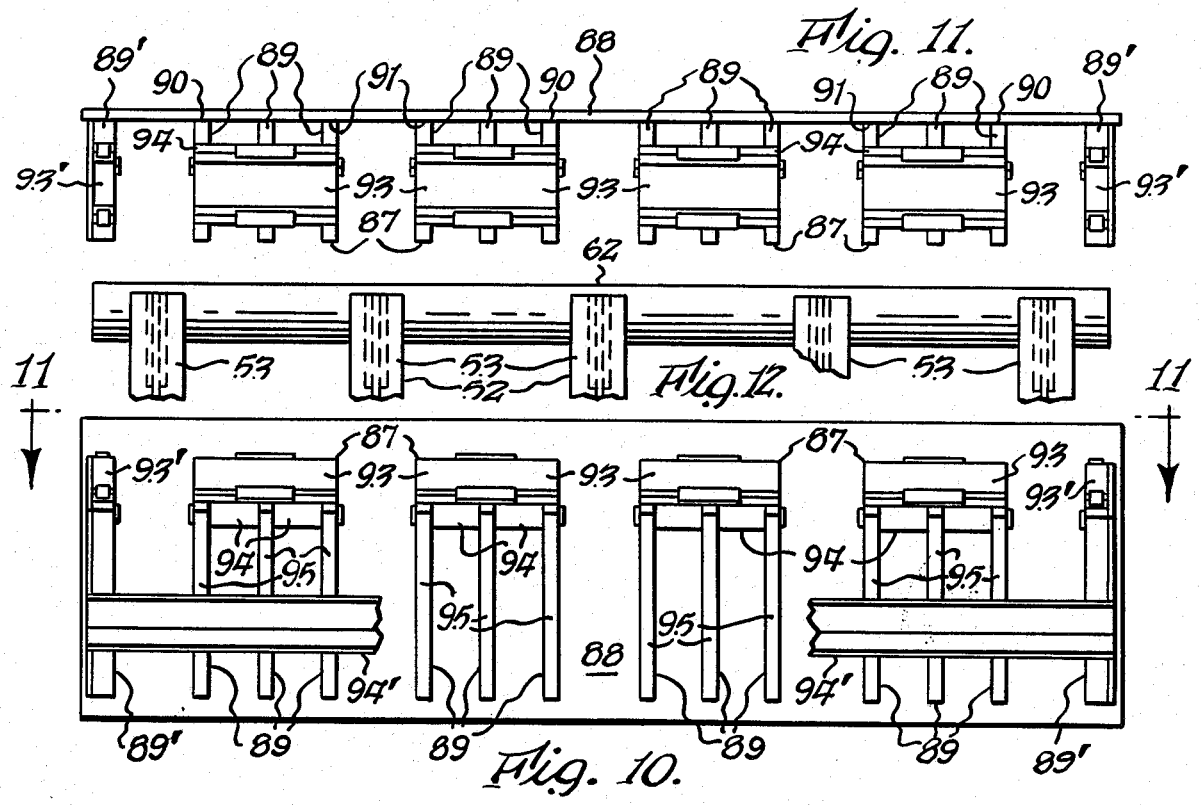
Fig. 11.
Fig. 12.
Fig. 10.

Fig. 13.
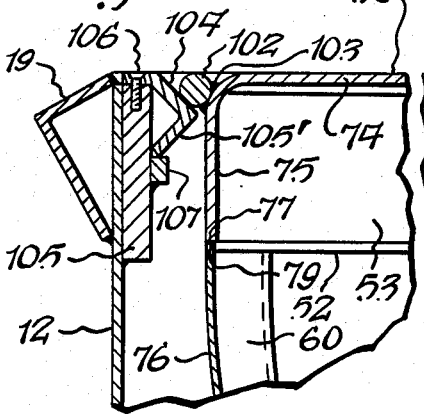
Fig. 14.
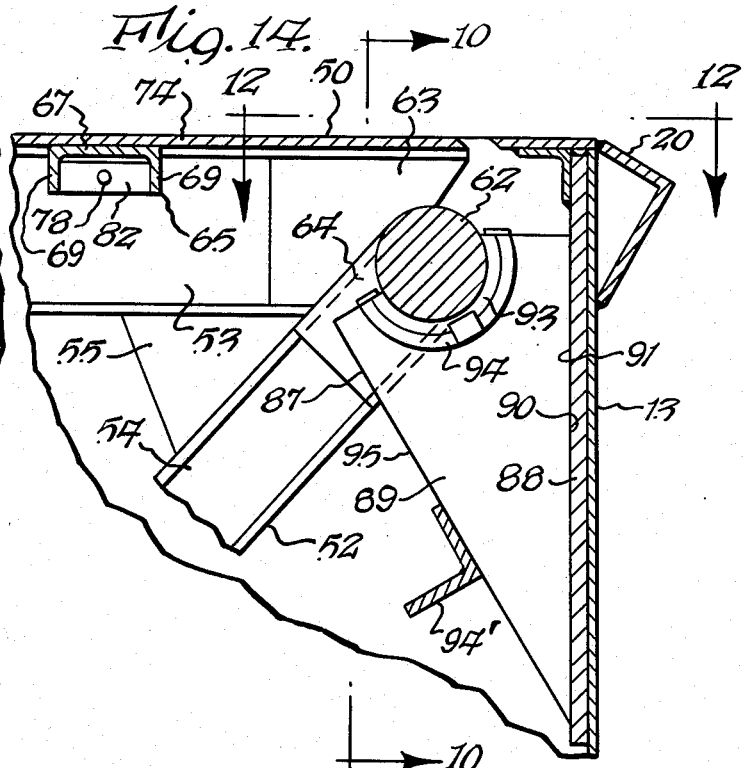
Fig. 15.
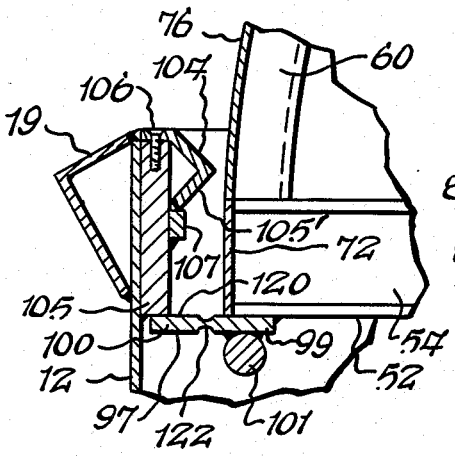
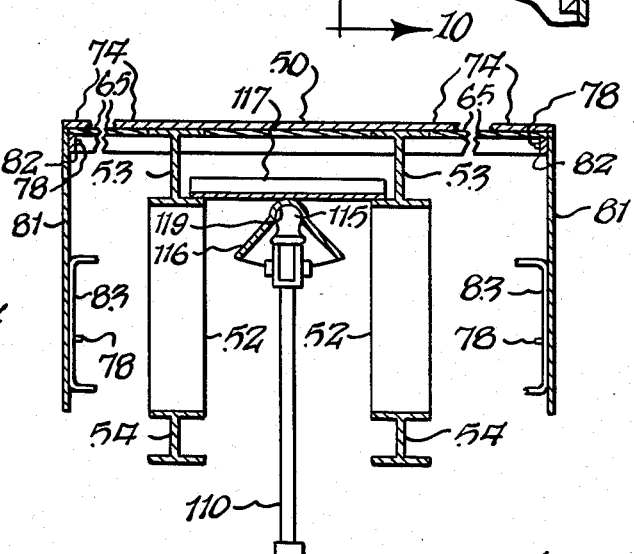
Fig. 16.
Fig. 17.
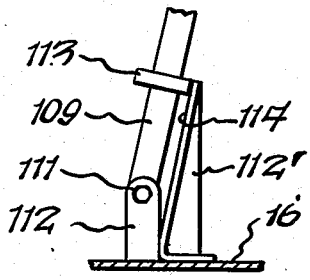

VEHICLE BARRIER CONSTRUCTION

BACKGROUND OF THE INVENTION

The present invention relates to an improved vehicle barrier construction for stopping unauthorized passage of vehicles.

By way of background, there are numerous vehicle barrier constructions known wherein a pivotal barrier member is movable from a retracted position in which a vehicle can pass over it to an extended position in which it obstructs vehicles. This general type of vehicle barrier is shown in U.S. Pat. Nos. 1,949,295, 2,362,912, 2,741,859 and 4,152,871. It is with an improvement over the foregoing type of vehicle barrier that this invention is concerned.

SUMMARY OF THE INVENTION

It is one object of the present invention to provide a vehicle barrier which can be detached from its mounting when it experiences an impact force above a predetermined value so that it will throw a vehicle into the air and thus disable it against further movement.

Another object of the present invention is to provide an improved vehicle barrier which is fabricated so as to absorb the energy of vehicle impact and thus stop a vehicle more efficiently.

A further object of the present invention is to provide an improved vehicle barrier which can be installed in an extremely simple and efficient manner. Other objects and attendant advantages of the present invention will readily be perceived hereafter.

The present invention relates to a vehicle barrier comprising a barrier having a roadway surface and a barrier surface, means mounting said barrier for movement between a retracted first position where said roadway surface lies substantially flush with a roadway and an extended second position where said barrier surface obstructs a vehicle on said roadway, and release means for permitting said barrier to pivot beyond said second position in the event said barrier surface receives an impact force above a predetermined value from a vehicle to thereby tend to raise said vehicle off of said roadway.

The present invention also relates to a vehicle barrier comprising a housing, a barrier having a roadway surface and a barrier surface, means for mounting said barrier for movement between a retracted position where said roadway surface lies substantially flush with a roadway and an extended position where said barrier surface obstructs a vehicle on said roadway, motor means effectively located between said housing and said barrier for moving said barrier between said retracted position and said extended position, and cooperating means on said housing and on said barrier for effecting automatic alignment between said barrier and said motor means upon installation of said barrier means into said housing.

The present invention also relates to a vehicle barrier comprising a housing, a barrier having a roadway surface and a barrier surface, means for mounting said barrier for movement between a retracted position where said roadway surface lies substantially flush with a roadway and an extended position where said barrier surface obstructs a vehicle on said roadway, and energy absorber means on said barrier for absorbing the energy of impact of a vehicle, said energy absorber means comprising a plurality of deformable members behind said barrier surface.

The various aspects of the present invention will be more fully understood when the following portions of the specification are read in conjunction with the accompanying drawings wherein:

BRIEF DESCRIPTION OF THE DRAWINGS

FIG. 1 is a plan view, partially broken away, of the improved vehicle barrier of the present invention;

FIG. 1*a* is a fragmentary cross sectional view taken substantially along line 1*a*—1*a* of FIG. 1 and showing the constructional details of the supporting struts which underlie the upper surface of the barrier;

FIG. 2 is a cross sectional view taken substantially long line 2—2 of FIG. 1, with parts partially broken away and showing the details of the barrier ribs;

FIG. 3 is a side elevational view taken from the right of FIG. 1;

FIG. 4 is a cross sectional view taken substantially along line 4—4 of FIG. 1, with parts partially broken away, showing the barrier in a fully retracted position;

FIG. 5 is a view similar to FIG. 4 and showing the barrier in a fully extended position;

FIG. 6 is a cross sectional view taken substantially along line 6—6 of FIG. 4 and showing the structure at the bottom of the housing;

FIG. 7 is a cross sectional view taken substantially along line 7—7 of FIG. 4 with certain parts omitted in the interest of clarity and showing various details of the barrier ribs;

FIG. 8 is a cross sectional view taken substantially along line 8—8 of FIG. 4 and showing essentially the relationship between the planar upper surface of the barrier and the barrier ribs;

FIG. 9 is a fragmentary cross sectional view taken substantially along line 9—9 of FIG. 4 and showing the structure of the lower portion of the barrier;

FIG. 10 is a view taken substantially in the direction of arrows 10—10 of FIG. 14 and showing the structure of the bearing supports mounted on the rear wall of the housing;

FIG. 11 is a view taken substantially in the direction of arrows 11—11 of FIG. 10 and showing the bearing structure mounted relative to the rear wall of the housing;

FIG. 12 is a view taken substantially in the direction of arrows 12—12 of FIG. 14 and showing the relationship between the pivot shaft and the ribs of the barrier;

FIG. 13 is a fragmentary cross sectional view taken substantially along line 13—13 of FIG. 1 and showing the relationship between the upper front edge of the barrier and the upper edge of the front wall when the barrier is in a fully retracted position;

FIG. 14 is a fragmentary cross sectional view taken substantially along line 14—14 of FIG. 1 and showing the relationship between the pivot shaft, the bearing supports therefor, and the barrier ribs when the barrier is in a fully retracted position;

FIG. 15 is a fragmentary cross sectional view taken within the enclosed area denoted FIG. 15 of FIG. 5 and showing the relationship between the front wall of the housing and the breakaway lip on the barrier when the barrier is in its fully extended position;

FIG. 16 is a fragmentary cross sectional view taken substantially along line 16—16 of FIG. 5 and showing the relationship between the bottom wall of the housing and the barrier when the barrier is in its fully extended position; and FIG. 17 is a fragmentary cross sectional view showing the support for the cylinder on the bottom wall of the housing.

DESCRIPTION OF THE PREFERRED EMBODIMENTS

Summarizing briefly in advance, the improved barrier of the present invention is movable from a fully retracted position, such as shown in FIG. 4, wherein its planar upper surface serves as a roadway, to a fully extended position, as shown in FIG. 5, wherein the arcuate surface of the barrier is in a position to obstruct the passage of vehicles. The barrier is collapsible to absorb the energy of impact, provided the total force of impact is below a predetermined value. However, if it exceeds the predetermined value, the barrier will pivot upwardly beyond its fully extended position and will tend to lift and overturn the vehicle which has struck it. Furthermore, the barrier itself is easily mountable and demountable from its associated housing for purposes of replacement and repair.

The improved vehicle barrier 10 of the present invention includes a housing 11 consisting of front wall 12, rear wall 13, side walls 14 and 15, and bottom wall 16. Walls 12 and 13 converge downwardly toward each other. The same is true of walls 14 and 15. Thus, there is a draft in the housing so that when it is set in cement 17 with a suitable lubricant between the walls and the cement, the housing 11 may be pulled out of the ground, if required, for replacement or repair. Angles 19, 20, 21 and 22 are welded to the upper edge portions of walls 12, 13, 14 and 15, respectively, to rigidize the walls in this area. The apices of the angles are substantially flush with the level of roadway 23 over which vehicles travel. Lifting lugs 24 (FIGS. 1 and 3) are welded at the junctions of angles 19 and 20 and walls 12 and 13, respectively, for receiving hooks for lifting the housing, as required, for both installing the housing into its associated pit and removing it therefrom. Channels 25 and 26 are welded to the inside surface 27 of front wall 12 and extend substantially the entire distance between side wall 14 and partition 29 (FIGS. 2 and 6) which extends between walls 12 and 13. Reinforcing channels 30 and 31 (FIGS. 2 and 4) are welded to the inside surface 32 of side wall 14 and extend substantially the entire distance between front wall 12 and rear wall 13. Reinforcing channels 33 and 34 are welded to side wall 15 and extend substantially the entire distance between front wall 12 and rear wall 13. Reinforcing channel 35 is welded to rear wall 13 and it extends substantially the entire distance between side wall 14 and partition wall 29. Channels 36 and 37 (FIG. 2) are welded to rear wall 13 and extend substantially the entire distance between partition 29 and side wall 15. All of the foregoing channels rigidize the wall sides of the housing against warping and they reinforce the walls against the fluid pressure exerted thereon by the concrete 17 when it is poured around housing 11 after the latter has been placed in a pit in the ground.

I-beams 40 and 41 are welded to the inside surface 42 of bottom wall 16. Channels 43 and 44 are welded to bottom wall 16 and extend between I-beams 40 and 41. An I-beam 45 is also welded to bottom wall 16 and extends between I-beams 43 and 44. A metal block 46 is welded to the top of I-beam 45 and extends substantially the entire distance between I-beams 40 and 41 (FIG. 6). The I-beams and channels welded to bottom wall 16 rigidize it. A conduit shielding housing 47 (FIGS. 1, 2 and 3) provide an enclosure for electrical and hydraulic conduits 49 which pass through end wall 15.

All of the walls of the housing are of heavy gauge steel approximately ¼ inch thick and are welded to each other to provide a fluid-tight enclosure. A sump 39 (FIGS. 2 and 6) extends downwardly from bottom wall 16 to collect liquid which may drop into housing 11, and a suitable sump pump and associated hose are associated with sump 39 to periodically drain it.

A retractible and extendible barrier 50 is pivotally mounted within housing 11 and is movable between the retracted position of FIG. 4 and the extended position of FIG. 5, upon the actuation of the fluid motors 51 which effectively extend between bottom wall 16 and barrier 50. Barrier 50 includes a plurality of substantially parallel ribs 52 which are suitably joined to each other. Each rib 52 consists of an upper I-beam 53 and a lower I-beam 54 spaced therefrom. I-beams 53 and 54 converge and are welded to each other at their point of convergence. A gusset 55 is welded between I-beams 53 and 54. An I-beam 56 has its opposite ends welded to I-beams 53 and 54. Channels 57 and 59 have their opposite ends welded to I-beams 53 and 54 and curved channel 60 also has its opposite ends welded to I-beams 53 and 54.

Ribs 52 are joined to each other as follows: A pivot shaft 62 is suitably welded to the ends of I-beams 53 and 54 as shown. A templet 63 is welded to opposite sides of each web of each I-beam 53 to increase the rigidity thereof proximate pivot shaft 62. A templet 64 is welded to the web on the opposite side of each I-beam 54 proximate pivot shaft 62 in the same manner. A plurality of struts 65 (FIGS. 1 and 1*a*) have their opposite ends welded to channels 53 at 66. Struts 65 are in the form of channels having a base 67 and legs 69. Bases 67 are flush with the top surfaces 70 of I-beams 53. This is achieved by cutting away the bases 67 to accommodate the flanges of the I-beams, as can be visualized from FIG. 1*a*. Thus, the top surfaces 70 of the I-beams and the outer surfaces of struts 65 lie in a single plane. Plates 71 (FIGS. 4 and 7) are welded across the flanges of the outer two I-beams 56 of the barrier. Also, a plate 72 (FIGS. 2 and 9) is welded across the ends of the three inner I-beams 54. Additional plates 73 are welded across the ends of the outer I-beams 54.

An outer steel plate 74 forms a planar roadway surface across the top of the grid formed by I-beams 53 and struts 65. The end of plate 74 is bent to the shape shown at 75 (FIG. 13) and is secured by welding to the outer ends of I-beams 53. The underside of plate 74 is spot-welded to the gridwork of I-beams 53 and struts 67 at select points where they contact each other.

A steel plate 76 of arcuate shape is spot-welded at select locations to the outer edges of curved channels 60. Plate 76 extends across all of the channels 60 and its upper edge 77 is located in contiguous relationship to edge 79 of portion 75 of upper plate 74 (FIG. 13). The lower edge 80 of plate 76 terminates immediately above the ends of I-beams 54 (FIG. 2). End plates 81 of sector shape are screwed by screws 78 to brackets 82 and 83 at the ends of barrier 50. Openings 85 are located at the junctures of plates 75 and 81 for receiving hooks for lifting barrier 50 in and out of housing 11.

The barrier 50 is supported within housing 11 in the following manner: Three central bearings 87 and two end bearings 89 are mounted on rear wall 13 for receiving spaced portions of pivot shaft 62. Each central bearing 87 includes a plurality of gusset-like plates 89 (FIGS. 10, 11 and 14) having their vertical edges 90 welded to surface 91 of plate 88 welded to rear wall 13. Bearing material 93 is suitably affixed to cylindrical backer member 94 which is welded to the upper portions of each support member 89. Gusset-like members 89', which are of the same shape as members 89, support bearings 93' which mount the ends of pivot shaft 62. An angle 94' (FIGS. 10 and 14) extends across and is welded to the surface 95 of each of the gusset-like members 89 and 89'.

A break-away plate 97 (FIGS. 4, 5 and 15) has its end portion 99 (FIG. 15) welded to the underside of the three central I-beams 54 so that the outer portion 100 extends outwardly from curved plate 76. A round bar 101 is welded to portion 99 of member 97 and it rests on the top of square block 46 when the barrier 50 is in the retracted position (FIG. 4). Bar 101 extends across only the three central ribs 52. A plurality of spaced round bars 102 are welded to upper plate 74 at 103 and they rest on the upper surface 104 of angle 105' when the barrier 50 is in the retracted position, angle 104 being secured to plate 105, which extends the entire distance between partition 29 and side wall 14, by means of a plurality of spaced screws 106. Angle 104 is also supported by bar 107 welded to plate 105 which is welded to front wall 12. Thus, when the barrier 50 is in it fully retracted position, it is supported (1) by pivot shaft 62 mounted in bearings 93, (2) by rod 101 resting on bar 46, and (3) by rods 102 bearing on angle 104.

The barrier 50 is raised from its fu11y retracted position of FIG. 4 to its fully extended position of FIG. 5 by spaced hydraulic motors 51 comprising cylinders 109 and pistons 110. The lower ends of cylinders 109 are pivotally mounted at 111 on brackets 112 which are welded to bottom wall 16. Supports 112' have their bases suitably attached to bottom wall 16, as by welding, and enlarged rings 113 loosely encircle cylinders 109. When the barrier 50 is not installed in housing 11, cylinders 109 will rest against plates 114 of supports 112'.

In order to install barrier 50 into housing 11, pistons 110 are retracted into cylinders 109. Hooks are applied to holes 85 of barrier 50 and a chain lift is used to lower barrier 50 into housing 11. During this lowering, shaft 62 is aligned with bearings 93 and rods 102 are aligned with angles 104. As the barrier 50 is lowered, a point will be reached where balls 115 at the ends of piston rods 110 will enter frustoconical funnel-shaped members 116 welded to channels 117 which in turn are welded to I-beams 53. The frustoconical funnel members 116 will guide balls 115 into mating engagement with sockets 119 at the ends of members 116. Thus, the ends of piston rods 110 are self-aligning with barrier 50 as it is lowered into position. During the installation, as balls 115 move into position, cylinders 109 will move away from plates 114 of supports 112'.

Normally roadway surface 74 of barrier 50 lies substantially even with roadway 23 when the barrier is in its fully retracted position of FIG. 4. However, as the need arises, motors 51 are actuated and the barrier is caused to pivot about the axis of pivot shaft 62 to the position of FIG. 5. It will continue its movement until the upper surface 120 of break-away plate 97 abuts the undersurface of plate 105. Plate 76 of barrier 50 will obstruct traffic traveling on roadway 23 in the direction of arrow 121 (FIG. 5). If the vehicle has a momentum less than a predetermined value, impact with plate 76 will cause it to buckle to the right in FIG. 5 to thereby deform this plate, and also deform the curved channels 60 which back up the plate, thereby absorbing the energy of impact. If the momentum is greater, channels 59 will also be deformed, and if the momentum is still greater, channels 57 will be deformed. The deformation of the various channels absorbs the energy of impact to thereby stop the vehicle. However, if the momentum of the vehicle exceeds a predetermined value, a point will be reached where break-away plate 97 fractures at weakened grooved portion 122, which may extend the entire length of plate 97. After fracture of plate 97, the impact of the vehicle will cause the barrier 50 to rotate clockwise about the axis of pivot shaft 62 beyond its fully extended position shown in FIG. 5. The continued movement of the vehicle to the right in FIG. 5 along with the pivotal motion of barrier 50 as it is supported on its pivot shaft 62 will cause the vehicle to be lifted from the ground and thrown upwardly, thereby upsetting it and causing it to stop before its forward motion causes it to move any appreciable distance beyond barrier 50. In other words, the barrier 50 may in certain instances severely damage the underside of the vehicle by ripping its oil pan, mutilating its transmission, or breaking its drive shaft. Also, it may cause the vehicle to tip over as a result of throwing it into the air. In any event, if the barrier 50 does not stop the vehicle before the break-away plate 97 fractures, it will tend to stop the vehicle by severely damaging it or turning it over after the break-away plate 97 has fractured. By way of example, and not of limitation, the break-away plate 97 may be designed to fracture when struck by a six-ton vehicle traveling at 35 mph. Below this impact value, the barrier 50 will be deformed to the degrees set forth above. However, it will be appreciated that break-away plate 97 may be designed to fracture at any desired impact value.

The various operating components, such as the pumps, motors, accumulators and various controls are mounted in a frame 124 (FIGS. 2 and 6) which is removable from housing 11. More specifically, frame 124 includes a pair of spaced channels 125 having holes at their opposite ends which receive pins 126 which extend upwardly from bottom wall 16. The frame also includes upstanding angles 127 having their bottom edges welded to channels 125. Cross braces, such as 129, bridge the upper ends of members 127 and a plate, such as 130, extends across channels 125 to support various pieces of equipment thereon. A cover 131 is suitably mounted on housing 11 and is supported on angles 132. When cover 131 is removed, a crane may be used to lift frame 124 out of the housing and replace it with another frame carrying substitute equipment.

An opening (not shown) is located in partition 29 for permitting various hydraulic conduits to pass from the hydraulic components to the fluid otors 51. Also openings are located in partition 29 proximate bottom wall 16 to permit drainage from the entire wall 16 to enter sump 39.

By way of example and not of limitation, the dimension A (FIG. 5) of the planar surface 74 may be about 50 inches, and the dimension B (FIG. 1) of planar surface 74 may be any desired value, depending on the width of the roadway to be obstructed. The remainder of the dimensions of the device of FIG. 5 can be readily visualized inasmuch as FIG. 5 is essentially drawn to scale, so that when the barrier 50 is in the extended position of FIG. 5, its uppermost portion at 102 is about 34 inches above the roadway level.

It can thus be seen that the improved barrier construction of the present invention is manifestly capable of achieving the above enumerated objects, and while preferred embodiments have been disclosed, it will be appreciated that the present invention is not limited thereto but may be otherwise embodied within the scope of the following claims.

What is claimed is:

1. A vehicle barrier comprising a housing having front and back sides extending upwardly from a bottom wall, front and back upper edge portions on said front and back sides, respectively, bearing means on said back side proximate said back upper edge portion, a barrier comprising an elongated body portion having front and back edges, a planar surface extending between said front and back edges, a pivot shaft on said back edge for mounting on said bearing means, a barrier surface on said body portion extending transversely to said planar surface, motor means for pivoting said body portion about said pivot shaft from a retracted position wherein said planar surface substantially bridges the space between said front and back upper edge portions to an extended position where said barrier surface extends upwardly from said front upper edge portion, stop means for limiting movement of said body portion beyond said extended position when said body portion is moved to said extended position by said motor means, and release means for permitting said body portion to pivot beyond said extended position when said barrier surface is subjected to an impact force above a predetermined value, said stop means comprising an abutment on said housing, and a frangible member on said body portion, said abutment comprising a first plate on said front wall proximate said front upper edge portion, and said frangible member comprising a second plate proximate said front edge of said body portion.

2. A vehicle barrier as set forth in claim 1 wherein said bearing means comprise a plurality of spaced plates mounted on said back side proximate said upper edge portion of said back side.

3. A vehicle barrier as set forth in claim 1 wherein said housing has a downward draft to permit it to be pulled outwardly from a pit in which it is located.

4. A vehicle barrier comprising a housing having front and back sides extending upwardly from a bottom wall, front and back upper edge portions on said front and back sides, respectively, bearing means on said back side proximate said back upper edge portion, a barrier comprising an elongated body portion having front and back edges, a planar surface extending between said front and back edges, a pivot shaft on said back edge for mounting said bearing means, a barrier surface on said body portion extending transversely to said planar surface, motor means for pivoting said body portion about said pivot shaft from a retracted position wherein said planar surface substantially bridges the space between said front and back upper edge portions to an extended position where said barrier surface extends upwardly from said front upper edge portion, stop means for limiting movement of said body portion beyond said extended position when said body portion is moved to said extended position by said motor means, and release means for permitting said body portion to pivot beyond said extended position when said barrier surface is subjected to an impact force above a predetermined value, said motor means comprising cylinder means, piston means on said cylinder means, pivot means pivotally mounting said cylinder means relative to said bottom wall, and an intentionally separable connection between said piston means and said body portion responsive to pivotal movement of said body portion to permit said body portion to pivot beyond said extended position.

5. A vehicle barrier as set forth in claim 4 wherein said stop means comprises an abutment on said housing, and a frangible member on said body portion.

6. A vehicle barrier as set forth in claim 4 wherein said body portion is in the shape of a sector of a cylinder wherein said planar surface comprises a radius of said sector and wherein said barrier surface comprises an arc of said sector, and wherein said pivot shaft is located substantially at the center of said sector.

7. A vehicle barrier as set forth in claim 4 including first support means on said front edge of said body portion proximate said planar surface, and second support means on said front upper edge portion for supporting said first support means when said planar surface substantially bridges the space between said front and back upper edge portions.

8. A vehicle barrier as set forth in claim 4 wherein said barrier comprises a plurality of substantially parallel ribs for supporting said planar surface and extending between said barrier surface and said pivot shaft, each of said ribs including deformable strut means located behind said barrier surface.

9. A vehicle barrier as set forth in claim 8 wherein said barrier surface is arcuate, and wherein said deformable strut means comprises an arcuate channel in contiguous relationship to said arcuate barrier surface.

10. A vehicle barrier as set forth in claim 4 including energy absorbing means on said barrier for absorbing the impact force of a vehicle.

11. A vehicle barrier comprising a housing having front and back sides extending upwardly from a bottom wall, front and back upper edge portions on said front and back sides, respectively, bearing means on said back side proximate said back upper edge portion, a barrier comprising an elongated body portion having front and back edges, a planar surface extending between said front and back edges, a pivot shaft on said back edge for mounting on said bearing means, a barrier surface on said body portion extending transversely to said planar surface, motor means for pivoting said body portion about said pivot shaft from a retracted position wherein said planar surface substantially bridges the space between said front and back upper edge portions to an extended position where said barrier surface extends upwardly from said front upper edge portion, stop means for limiting movement of said body portion beyond said extended position when said body portion is moved to said extended position by said motor means, and release means for permitting said body portion to pivot beyond said extended position when said barrier surface is subjected to an impact force above a predetermined value, said bearing means supporting said pivot shaft substantially only on the underside thereof, barrier support means under said barrier for supporting said barrier in its retracted position, an intentionally separable connection between said motor means and said barrier responsive to pivotal movement of said barrier beyond said extended position to disengage said barrier from said motor means, and means on said barrier for attachment to a lifting device for lifting said barrier out of said housing without requiring prior disengagement between said pivot shaft and said bearing means and between said barrier means and said barrier support means and between said barrier means and said motor means.

12. A vehicle barrier as set forth in claim 11 wherein said motor means comprises a piston and cylinder, cylinder mounting means pivotally mounting said cylinder relative to said bottom wall, and piston mounting means pivotally mounting said piston relative to said barrier.

13. A vehicle barrier comprising a housing having front and back sides extending upwardly from a bottom wall, front and back upper edge portions on said front and back sides, respectively, bearing means on said back side proximate said back upper edge portion, a barrier comprising an elongated body portion having front and back edges, a planar surface extending between said front and back edges, a pivot shaft on said back edge for mounting on said bearing means, a barrier surface on said body portion extending transversely to said planar surface, motor means for pivoting said body portion about said pivot shaft from a retracted position wherein said planar surface substantially bridges the space between said front and back upper edge portions to an extended position where said barrier surface extends upwardly from said front upper edge portion, stop means for limiting movement of said body portion beyond said extended position when said body portion is moved to said extended position by said motor means, and release means for permitting said body portion to pivot beyond said extended position when said barrier surface is subjected to an impact force above a predetermined value, said motor means comprising a piston and cylinder, cylinder mounting means pivotally mounting said cylinder relative to said bottom wall, and piston mounting means pivotally mounting said piston relative to said barrier, said piston mounting means comprising an inverted funnel-like member, and a ball-joint effectively positioned between said funnel-like member and said barrier, said ball joint comprising a ball member at the end of said piston and a ball receptable at the end of said funnel-like member, whereby said funnel-like member guides said ball member toward said ball receptacle.

14. A vehicle barrier comprising a housing, a barrier having a roadway surface and a barrier surface, means for mounting said barrier for movement between a retracted position where said roadway surface lies substantially flush with a roadway and an extended position where said barrier surface obstructs a vehicle on said roadway, motor means effectively located between said housing and said barrier for moving said barrier between said retracted position and said extended position, and cooperating means on said housing and on said barrier for effecting automatic alignment between said barrier and said motor means upon installation of said barrier means into said housing, said cooperating means comprising a support for orienting said motor means in a predetermined position, and guide means on said barrier for guiding motor means into engagement with said barrier means, said motor means comprising a piston and cylinder, and said support orienting said cylinder in a predetermined alignment, and said guide means comprising funnel-like means for guiding said piston into operative relationship with said barrier.

15. A vehicle barrier comprising a housing having front and back sides extending upwardly from a bottom wall, front and back upper edge portions on said front and back sides, respectively, bearing means on said back side proximate said back upper edge portion, a barrier comprising an elongated body portion having front and back edges, a planar surface extending between said front and back edges, a pivot shaft on said back edge for mounting on said bearing means, a barrier surface on said body portion extending transversely to said planar surface, motor means for pivoting said body portion about said pivot shaft from a retracted position wherein said planar surface substantially bridges the space between said front and back upper edge portions to an extended position where said barrier surface extends upwardly from said front upper edge portion, stop means for limiting movement of said body portion beyond said extended position when said body portion is moved to said extended position by said motor means, add release means for permitting said body portion to pivot beyond said extended position when said barrier surface is subjected to an impact force above a predetermined value, and a separable fit between said pivot shaft and said bearing means to permit separation therebetween when said barrier means is subjected to said impact force beyond said predetermined value.

* * * * *

UNITED STATES PATENT AND TRADEMARK OFFICE

CERTIFICATE OF CORRECTION

PATENT NO. : 4,627,763

DATED : December 9, 1986

INVENTOR(S) : Mitchel B. Roemer and Nicholas B. Roemer

It is certified that error appears in the above-identified patent and that said Letters Patent are hereby corrected as shown below:

Column 7, line 54 (claim 4), after "mounting" insert --on--.

Column 10, line 38 (claim 15), change "add" to --and--.

Signed and Sealed this

Seventeenth Day of February, 1987

*Attest:*

DONALD J. QUIGG

*Attesting Officer*

*Commissioner of Patents and Trademarks*